US010915068B2

(12) United States Patent
Chi

(10) Patent No.: US 10,915,068 B2
(45) Date of Patent: Feb. 9, 2021

(54) QUARTZ CLOCK TYPE TIMER MOVEMENT

(71) Applicant: HANGZHOU JINGCHENG SANHE TIMER INDUSTRY CO., LTD., Hangzhou (CN)

(72) Inventor: Hanjun Chi, Hangzhou (CN)

(73) Assignee: HANGZHOU JINGCHENG SANHE TIMER INDUSTRY CO., LTD., Hangzhou (CN)

( * ) Notice: Subject to any disclaimer, the term of this patent is extended or adjusted under 35 U.S.C. 154(b) by 194 days.

(21) Appl. No.: 16/313,016

(22) PCT Filed: Aug. 3, 2017

(86) PCT No.: PCT/CN2017/095800

§ 371 (c)(1),
(2) Date: Dec. 22, 2018

(87) PCT Pub. No.: WO2018/133377

PCT Pub. Date: Jul. 26, 2018

(65) Prior Publication Data

US 2020/0310357 A1 Oct. 1, 2020

(30) Foreign Application Priority Data

Jan. 21, 2017 (CN) ..... 2017 1 0048127

(51) Int. Cl.

| | |
|---|---|
| ***G04F 3/02*** | (2006.01) |
| ***G04C 3/00*** | (2006.01) |
| ***G04C 21/28*** | (2006.01) |

(52) U.S. Cl.

CPC ..... *G04F 3/02* (2013.01); *G04C 3/008* (2013.01); *G04C 21/28* (2013.01)

(58) Field of Classification Search

CPC .. G04F 3/00; G04F 3/02; G04C 3/008; G04C 21/28

USPC ..... 368/98, 99

See application file for complete search history.

(56) References Cited

U.S. PATENT DOCUMENTS

| | | | | |
|---|---|---|---|---|
| 3,953,965 | A | 5/1976 | Tobeta | |
| 7,465,085 | B2 * | 12/2008 | McDonough | G04F 1/005 368/109 |

FOREIGN PATENT DOCUMENTS

| | | | |
|---|---|---|---|
| CN | 2163397 | Y | 4/1994 |
| CN | 1293386 | A | 5/2001 |
| CN | 201429778 | Y | 3/2010 |
| CN | 203414739 | U | 1/2014 |
| CN | 106773609 | A | 5/2017 |

* cited by examiner

*Primary Examiner* — Edwin A. Leon
*Assistant Examiner* — Jason M Collins
(74) *Attorney, Agent, or Firm* — PROI Intellectual Property US; Klaus Michael Schmid

(57) ABSTRACT

A timer movement includes a shell; a quartz movement body, a sound component and a central output wheel assembly driven by the quartz movement body are disposed in the shell, a printed circuit board and a traveling wheel driven by the central output wheel assembly are disposed at the top of the shell, and a battery compartment is disposed at the bottom of the shell. A leaf spring and a switch pillar are disposed on the printed circuit board, and a toggle rod forcing the leaf spring to bend so as to touch the switch pillar is disposed on the traveling wheel.

4 Claims, 7 Drawing Sheets

QUARTZ CLOCK TYPE TIMER MOVEMENT

TECHNICAL FIELD

The present invention relates to a timing device, in particular to a timer.

BACKGROUND

Most existing timers adopt a mechanical movement, thereby having the following defects: before use, a scale cover needs to be rotated by one circle (to tighten the spring of the mechanical movement) and then reversely rotated to the timing position; however, many initial users fail to use the timers in this way and directly rotate the scale cover to the timing position, resulting in an extremely short prompt ringtone; in the timing process, the mechanical movement continuously makes ticking sounds, users may be disturbed by the noise when studying and working, and thus, the mechanical movement is inapplicable to a quiet environment; and the timing error of the mechanical movement is large.

SUMMARY

The objective of the present invention is to overcome the above defects of the related art and to provide a quartz clock-type timer movement, which has the characteristics of convenient operation, low noise and accurate timing.

The technical scheme of the present invention is as follows:

A quartz clock-type timer movement is characterized by comprising a shell, wherein a quartz movement body, a sound component and a central output wheel assembly driven by the quartz movement body are disposed in the shell. A PCB and a traveling wheel driven by the central output wheel assembly are disposed at the top of the shell. A battery compartment is disposed at the bottom of the shell.

A leaf spring and a switch pillar are disposed on the PCB. A toggle rod forcing the leaf spring to bend to touch the switch pillar is disposed on the traveling wheel.

The central output wheel assembly comprises a central wheel axle rotatably positioned on the quartz movement body and connected with the traveling wheel, a transmission gear rotatably positioned on the central wheel axle and engaged with an output gear of the quartz movement body, and a spring pressing sheet used for tightly pressing the transmission gear and the central wheel axle together to generate driving frictional force therebetween.

The transmission gear is provided with a central hole matched with the central shaft, and a concave hole matched with a pressing disc of the central wheel axle is formed in the bottom surface of the transmission gear.

The timer movement further comprises a limiting assembly used for limiting the rotation angle of the traveling wheel. The limiting assembly comprises a limiting block positioned on the shell in a swinging mode, a stop frame disposed on the shell and used for limiting the swing angle of the limiting block, and a toggle block disposed on the traveling wheel and matched with the limiting block.

The toggle rod is disposed on the upper side of the outer circumferential surface of the traveling wheel and located above the PCB. The toggle block is disposed on the lower side of the outer circumferential surface of the traveling wheel. The toggle rod is kept away from the limiting block in the axis direction of the central wheel axle.

A mounting hole is formed in the center of the PCB, and the traveling wheel is disposed in the mounting hole.

The present invention has the following beneficial effects:

The quartz movement body is adopted by the present invention to provide a driving force for the timer movement, the timing duration can be set by rotating the traveling wheel, and in the countdown state, power provided by the quartz movement body is transmitted onto the traveling wheel through the central output wheel assembly; and when the set time is reached, the sound component is started at the moment the traveling wheel triggers the internal switch. Thus, the quartz clock-type timer movement of the present invention achieves accurate timing, noise is hardly generated in work, the timing time can be set conveniently, and various types of sounds can be made; and the quartz clock-type timer movement can be used for making timers in various shapes.

DETAILED DESCRIPTION OF THE INVENTION

The present invention is further described as follows in combination with the drawings attached to the specification. However, the present invention is not limited to the following embodiment.

Figure 8:
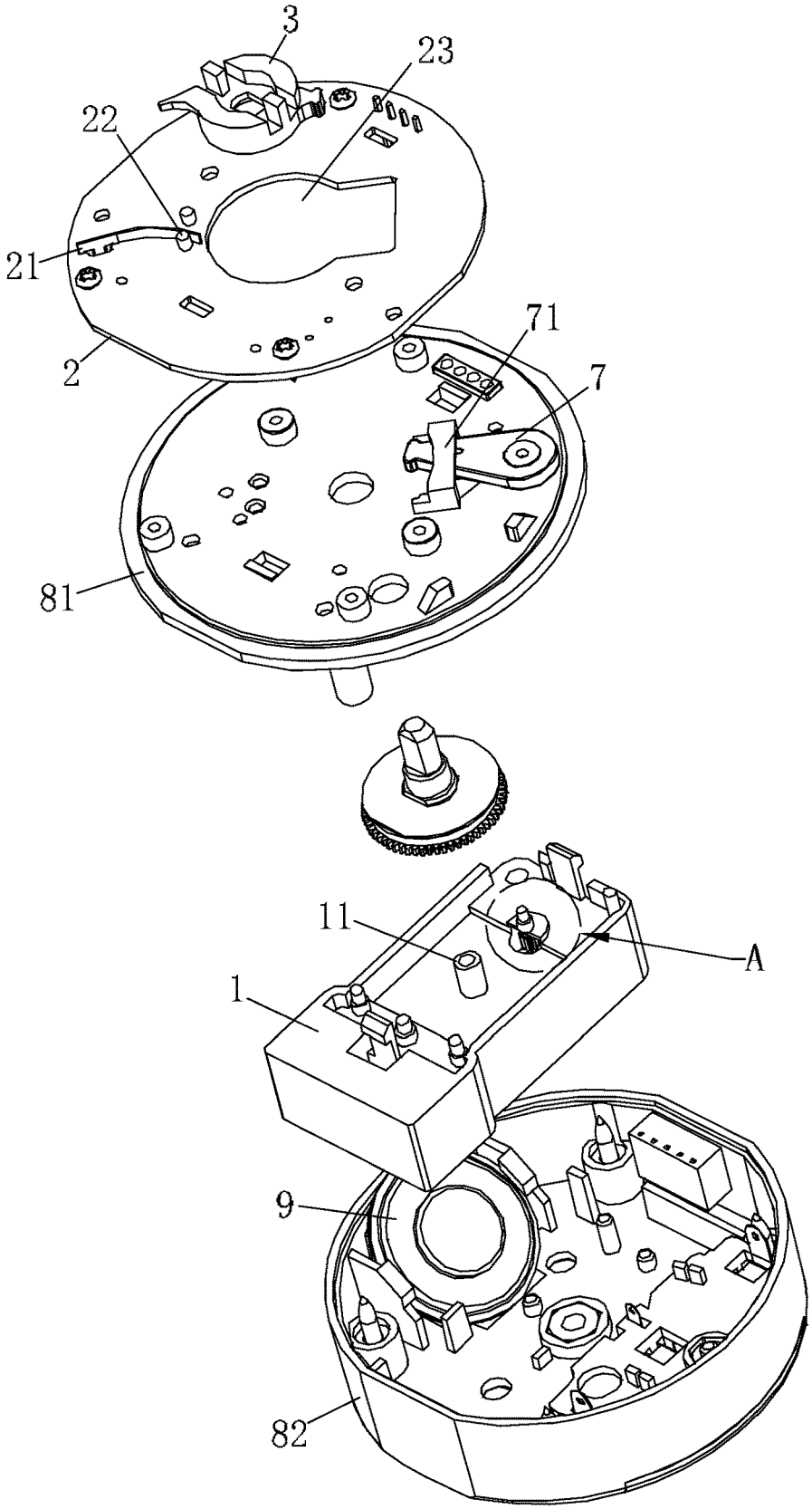
FIG. 8 is an exploded view of the present invention.

As is shown in FIG. 8, a quartz clock-type timer movement comprises a shell, a quartz movement body 1, a PCB 2, a central output wheel assembly, a traveling wheel 3, a sound component (preferably a horn) 9 and a limiting assembly. The shell comprises a base 82 and an upper cover 81. A battery compartment 83, a bolt hole 84 and a plurality of positioning holes 85 are disposed at the bottom of the base. A battery mounted in the battery compartment is used for supplying power to the quartz movement body and the PCB. The quartz movement body, the sound component and the central output wheel assembly are encapsulated in the shell. The sound component is disposed at the bottom of the quartz movement body. The central output wheel assembly is disposed at the top of the quartz movement body.

The central output wheel assembly comprises a central wheel axle 4, a transmission gear 5 and a spring pressing sheet 6 which are coaxially disposed. The central wheel axle comprises a pressing disc 42 located at the bottom and a central shaft 41 disposed on the pressing disc. An assembly notch 46 is formed in the upper portion of the central shaft. The central shaft is rotatably positioned on a support column 11 of the quartz movement body (a shaft hole matched with the support column is formed in the bottom surface of the pressing disc), and the central shaft stretches upwards out of the shell through a through hole of the upper cover.

Figure 9:
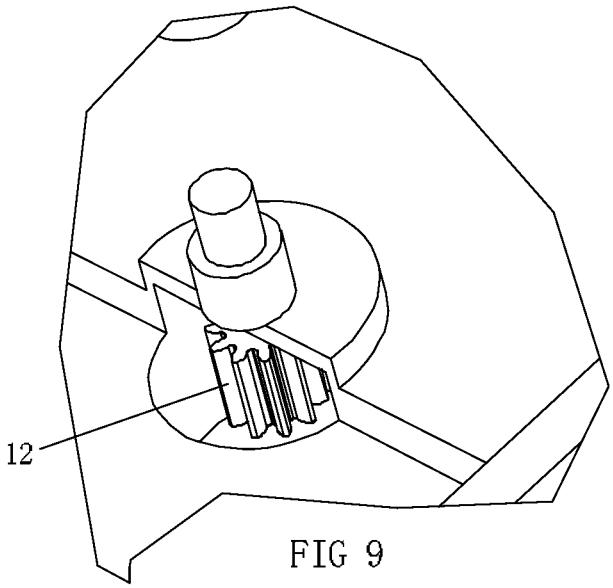
FIG. 9 is an amplified structural view of part A in FIG. 8.
Figure 10:
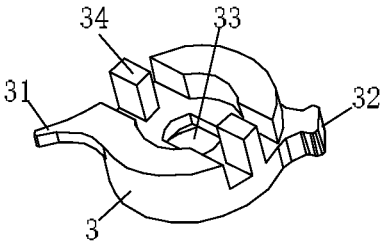
FIG. 10 is a perspective structural view of a traveling wheel of the present invention.
Figure 11:
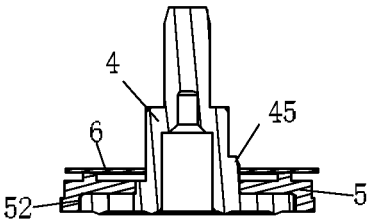
FIG. 11 is a front structural view of a central output wheel assembly of the present invention.
Figure 12:
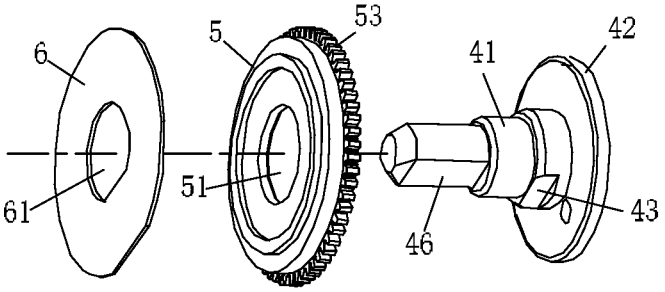
FIG. 12 is an exploded view of a central output wheel assembly of the present invention.

The transmission gear is provided with a central hole 51 allowing the central shaft to penetrate through, a concave hole 52 located on the bottom surface and transmission teeth 53 located on the outer circumferential surface. The transmission gear is rotatably positioned on the central wheel axle. The concave hole of the transmission gear covers the pressing disc of the central wheel axle (the inner diameter of the concave hole is greater than the outer diameter of the pressing disc). The transmission teeth of the transmission gear are engaged with an output gear 12 (shown in FIG. 9) of the quartz movement body. The central shaft is sequentially sleeved with the transmission gear and the spring pressing sheet. The edge shape of a pressing sheet central hole 61 in the spring pressing sheet is matched with the shape of the plane 43 part of the central shaft (so that the spring pressing sheet and the central shaft cannot rotate relatively), a rivet point 45 on the central shaft deforms after being riveted so as to firmly fix the spring pressing sheet on the central shaft, and a proper axial pressure is applied to the transmission gear. The central wheel axle and the transmission gear are tightly pressed together by means of the axial pressure, and thus power of the quartz movement body can be transmitted onto the central wheel axle through the transmission gear (friction materials can be disposed between the top surface of the pressing disc and the bottom surface of the concave hole to provide sufficient frictional force). The quartz movement body, the PCB and the central output wheel assembly can be purchased additionally.

The PCB and the traveling wheel are disposed at the top of the shell. The PCB is mounted on the upper cover of the shell. A mounting hole 23 matched with the traveling wheel is formed in the center of the PCB. A leaf spring 21 and a switch pillar 22 (both connected with the PCB) are further disposed on the top surface of the PCB. The outer end of the leaf spring is fixed to the outer edge of the PCB, and the inner end of the leaf spring is suspended and points to the center of the PCB. The switch pillar is fixed to one side of the inner end of the leaf spring. When stressed to bend, the leaf spring makes contact with the switch pillar to enable a chip of the PCB to generate a signal. When the leaf spring is separated from the switch pillar, the chip of the PCB also generates a signal.

Figure 1:
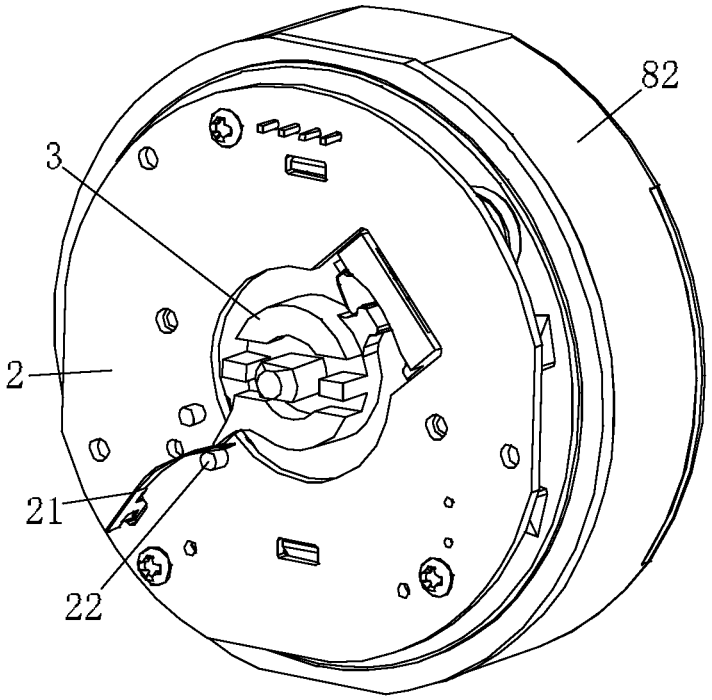
FIG. 1 is a first perspective structural view of one embodiment of the present invention.
Figure 2:
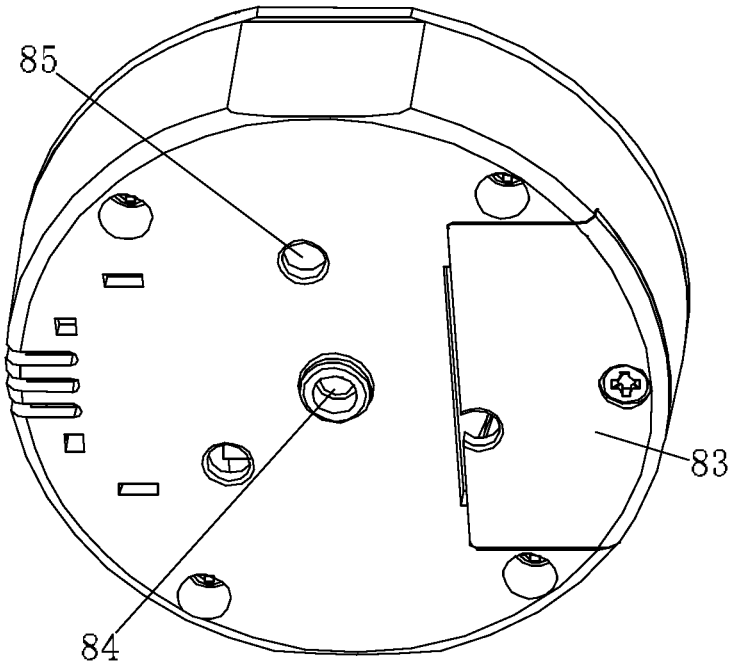
FIG. 2 is a second perspective structural view of the present invention.
Figure 3:
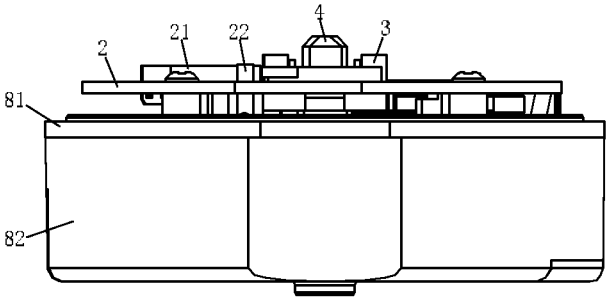
FIG. 3 is a front structural view of the present invention.
Figure 4:
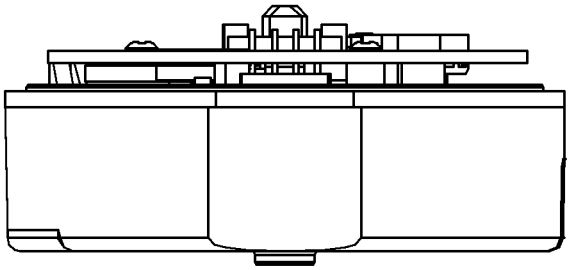
FIG. 4 is a rear structural view of the present invention.

The traveling wheel is disposed in the mounting hole of the PCB and mounted on the central shaft of the central wheel axle. A connecting hole 33 fixedly connected with the central shaft is formed in the center of the traveling wheel (the shape of the connecting hole is matched with the shape of the assembly notch 46 of the central shaft). A lug 34 on the traveling wheel is matched with an upper shell 91 of a timer. The traveling wheel can be rotated through the lug by rotating the upper shell of the timer. A toggle rod 31 and a toggle block 32 (as is shown in the figures, the toggle rod and the toggle block are disposed symmetrically) are disposed on the outer circumferential surface of the traveling wheel. The toggle rod is disposed on the upper side (the upper side in FIG. 3) of the outer circumferential surface of the traveling wheel and located above the PCB (when rotating, the toggle rod intervenes with the leaf spring, but is kept away from a limiting block 7 in the axis direction of the central wheel axle). The toggle block is disposed on the lower side of the outer circumferential surface of the traveling wheel (the lower side in FIG. 3) and located in the mounting hole (the toggle block is as high as the PCB, and the rotation radius of the toggle block is smaller than the radius of the mounting hole).

The limiting assembly comprises the limiting block 7, a stop frame 71 and the toggle block 32. The limiting block is positioned on the upper cover in a swinging mode. The stop frame is disposed on the upper cover and used for limiting the swing angle of the limiting block. When rotating, the traveling wheel drives the limiting block to rotate through the toggle block. If the traveling wheel is excessively rotated by users in the countdown state, the limiting block will be stopped by the stop frame and cannot continue to rotate anymore when moving to an extreme position, and the toggle block prevents the traveling wheel from continuing to rotate by stopping the limiting block.

Figure 13:
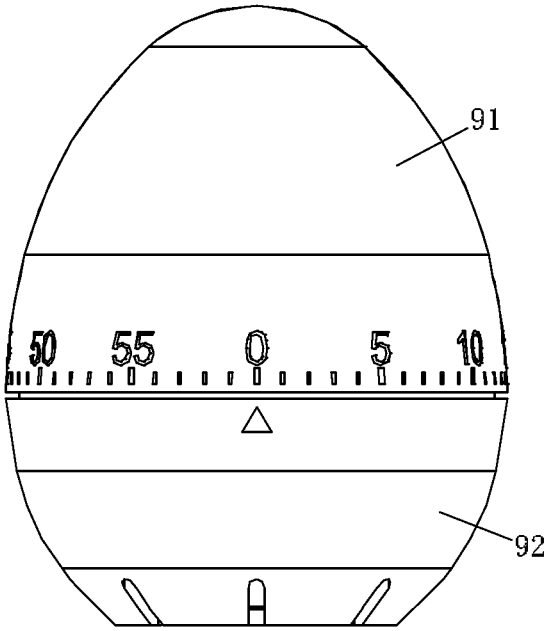
FIG. 13 is a front structural view of the present invention assembled in a timer shell body (edge-shaped timer shell body).
Figure 14:
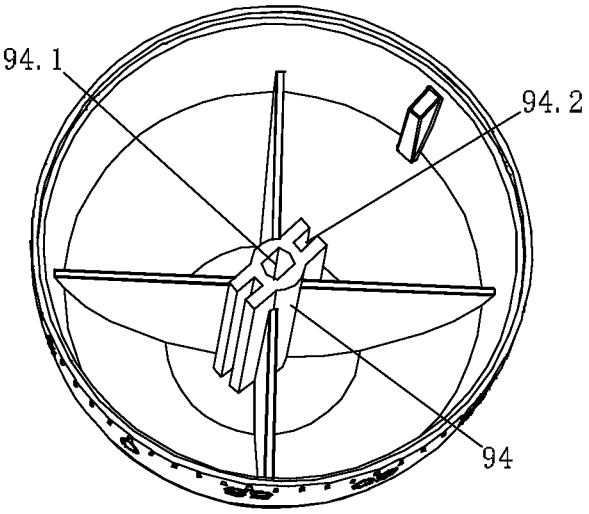
FIG. 14 is a perspective structural view of an upper shell.
Figure 15:
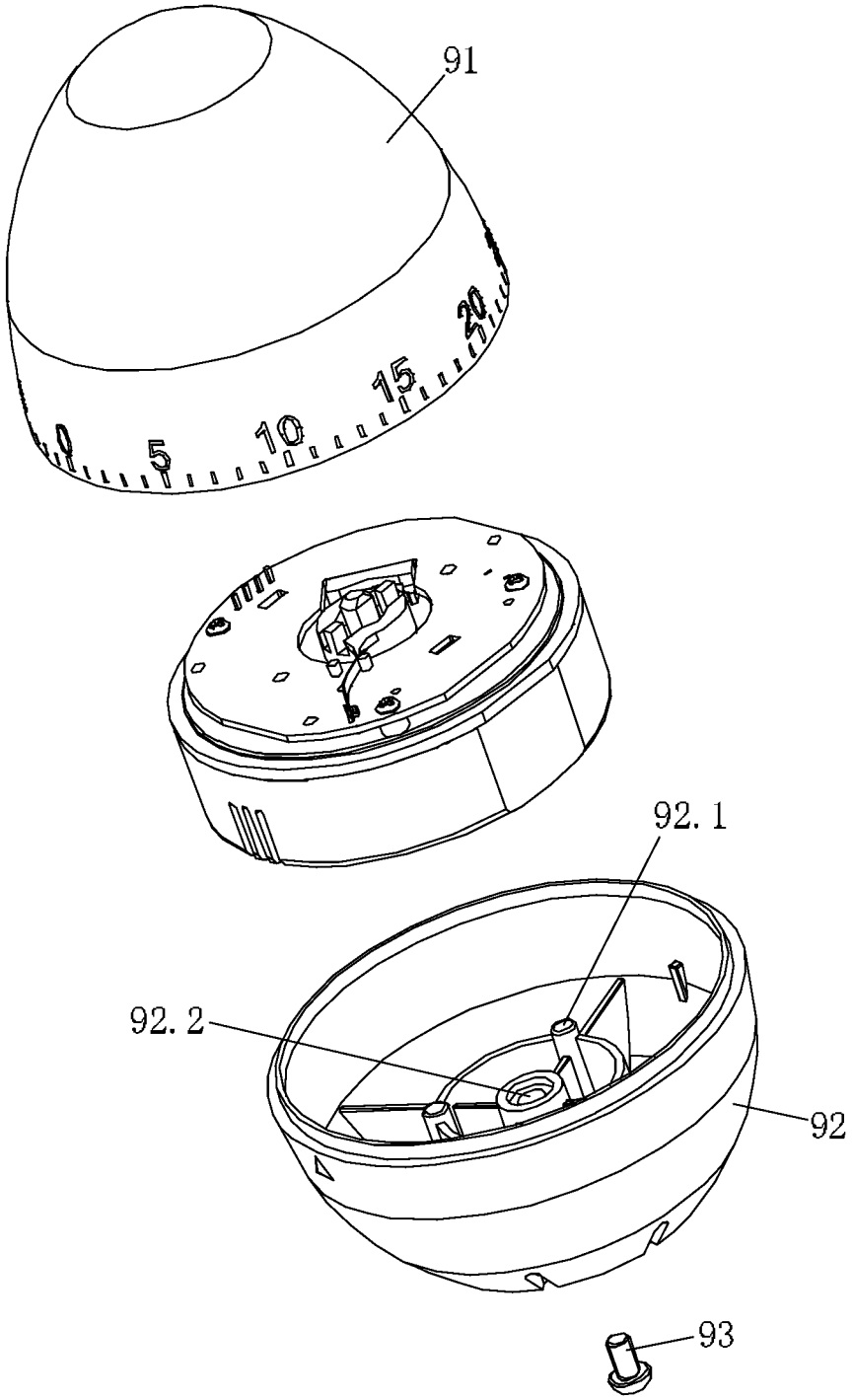
FIG. 15 is an exploded view of FIG. 13.

As is shown in FIG. 13, in a specific application embodiment, the quartz clock-type timer movement is assembled in a timer shell body. The timer shell body comprises an upper shell 91 and a lower shell 92. A bolt insertion hole 92.2 and a positioning column 92.1 cooperatively inserted into the positioning hole of the base are disposed in the lower shell. The quartz clock-type timer movement is placed in the lower shell (the positioning column of the lower shell is inserted into the positioning hole of the base), and a bolt 93 then penetrates through the bolt insertion hole and is screwed into the bolt hole of the base, so that the quartz clock-type timer movement and the lower shell are fixedly connected. The upper shell 91 is rotatably positioned on the lower shell. A connecting column 94 is disposed in the upper shell. An insertion hole 94.1 is formed in the connecting column, and an insertion groove 94.2 is further formed outside the connecting column. The connecting column is cooperatively inserted into the central shaft axle and the traveling wheel to fixedly connect the upper shell with the quartz clock-type timer movement, the central shaft of the central shaft axle is inserted into the insertion hole of the connecting column, and the lug of the traveling wheel is inserted into the insertion groove of the connecting column (the torque applied to the upper shell can be transferred onto the central shaft axle). A countdown scale ring is arranged on the outer circumferential surface of the upper shell, and the zero position of the scale also serves as the 60-minute countdown position. When users manually rotate the upper shell, the traveling wheel and the central wheel axle are driven to rotate at the same time; and when the quartz movement body drives the traveling wheel to rotate, the upper shell also rotates.

By setting relevant parameters such as the swing angle and width of the limiting block and the width of the toggle block, it is ensured that the extreme rotation positions of the traveling wheel in both directions completely overlap (the rotation range of the traveling wheel is 360°), and thus the quartz clock-type timer movement of the present invention can completely record time for 60 minutes. The timing duration realized through 360° rotation of the traveling wheel can also be set to two hours, one minute or any other time by adjusting the chip in the PCB.

Figure 5:
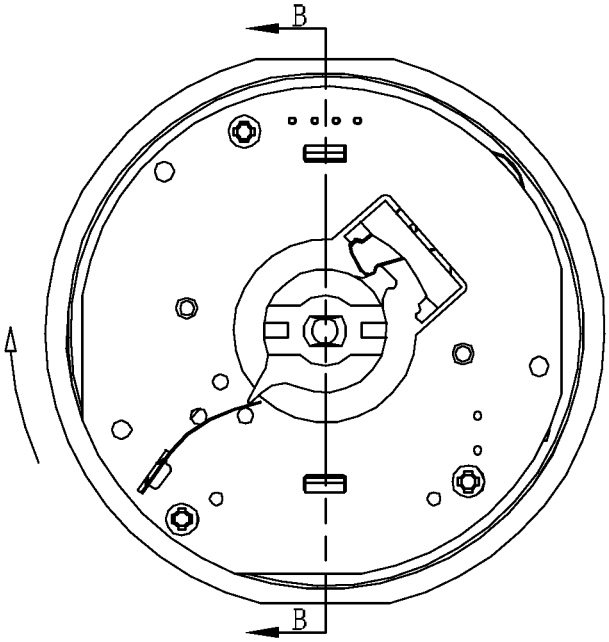
FIG. 5 is a top structural view of the present invention (zero position).
Figure 6:
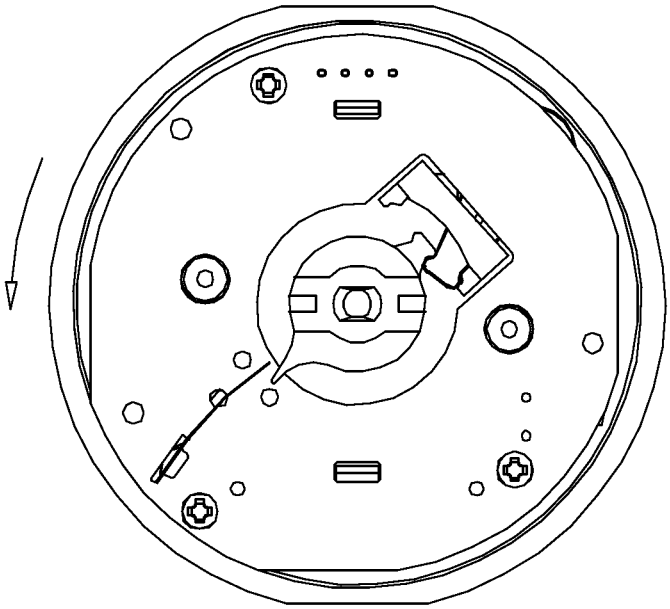
FIG. 6 is a top structural view of the present invention (60-minute countdown position).
Figure 7:
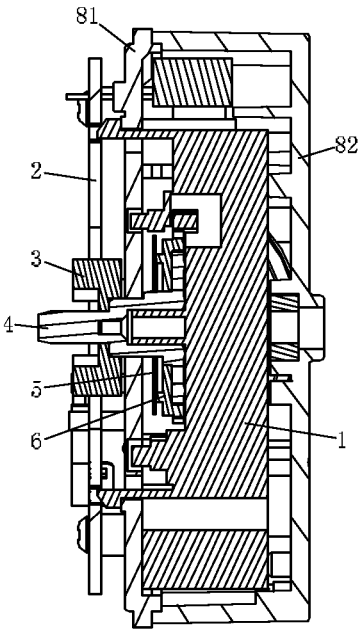
FIG. 7 is a sectional structural view of FIG. 5 in the B-B direction.

The operating method of the present invention is as follows:

1. FIG. 5 shows the zero position, the traveling wheel anticlockwise rotates to the extreme position (the limiting block is located at the extreme position in the clockwise direction), and the leaf spring is pressed on the switch pillar by the traveling wheel;

2. The countdown time is set: the traveling wheel is clockwise rotated in the arrow direction in FIG. 5, at this moment, the frictional force between the transmission gear and the central wheel axle is not large enough to push the output gear of the quartz movement body, and thus the central wheel axle slips (the central wheel axle rotates, but the transmission gear does not rotate); meanwhile, after the toggle rod of the traveling wheel rotates away, the leaf spring is separated from the switch pillar to automatically return to the suspension state by means of self elasticity, and the chip of the PCB sends out a signal to start the quartz movement body; as is shown in FIG. 6, if the traveling wheel is clockwise rotated to the extreme position (the limiting block is pushed to the extreme position in the anticlockwise direction), the rotation angle of the traveling wheel is 360°, and the set countdown time is 60 minutes; if the traveling wheel is clockwise rotated to any position (the rotation angle is smaller than 360°, the set countdown time (shorter than 60 minutes) depends on the rotation angle of the traveling wheel.

3. The countdown begins, and the quartz movement body drives the traveling wheel to anticlockwise rotate in the arrow direction in FIG. 6 through the central output wheel assembly (the transmission gear drives the central wheel axle to rotate at the same time through frictional force, and the central wheel axle then drives the traveling wheel to rotate);

4. When the traveling wheel rotates to the position shown in FIG. 5, the leaf spring is bent by the traveling wheel and touches the switch pillar, the PCB generates a signal to start the horn to make sounds to prompt users, and the quartz movement body is stopped at this moment, wherein the sound time can be set through the chip in the PCB.

What is to be claimed is:

1. A timer movement comprising a shell, wherein a quartz movement body, a sound component and a central output wheel assembly driven by the quartz movement body are disposed in the shell, a Printed Circuit Board (PCB) and a traveling wheel driven by the central output wheel assembly are disposed at a top of the shell, and a battery compartment is disposed at a bottom of the shell;

wherein the timer movement is configured such that the traveling wheel can rotate so as to set a timing duration, and in a countdown state, power provided by the quartz movement body can be transmitted onto the traveling wheel through the central output wheel assembly; and when the set timing duration is reached, the sound component is started at the moment the traveling wheel triggers an internal switch; wherein a leaf spring and a switch pillar are disposed on the PCB, and a toggle rod forcing the leaf spring to bend so as to touch the switch pillar is disposed on the traveling wheel, wherein the central output wheel assembly comprises a central wheel axle rotatably positioned on the quartz movement body and connected with the traveling wheel, a transmission gear rotatably positioned on the central wheel axle and engaged with an output gear of the quartz movement body, and a spring pressing sheet used for pressing the transmission gear and the central wheel axle together to generate a driving frictional force between the transmission gear and the central wheel axle;

wherein the transmission gear is provided with a central hole matched with a central shaft, and a concave hole matched with a pressing disc of the central wheel axle is formed in a bottom surface of the transmission gear.

2. The timer movement according to claim 1, further comprising a limiting assembly used for limiting a rotation angle of the traveling wheel, wherein the limiting assembly comprises a limiting block positioned on the shell in a swinging mode, a stop frame disposed on the shell and used for limiting a swing angle of the limiting block, and a toggle block disposed on the traveling wheel and matched with the limiting block.

3. The timer movement according to claim 2, wherein the toggle rod is disposed on an upper side of an outer circumferential surface of the traveling wheel and located above the PCB, the toggle block is disposed on a lower side of the outer circumferential surface of the traveling wheel, and the toggle rod is kept away from the limiting block in an axis direction of the central wheel axle.

4. The timer movement according to claim 3, wherein a mounting hole is formed in a center of the PCB, and the traveling wheel is disposed in the mounting hole.

* * * * *